US005183217A

United States Patent [19]

Holler et al.

[11] Patent Number: 5,183,217

[45] Date of Patent: Feb. 2, 1993

[54] CABLE PACK WINDING AND PAYOUT SYSTEM

[75] Inventors: Roger A. Holler, Warminster; Peter R. Ulrich, Perkasie, both of Pa.

[73] Assignee: The United States of America as represented by the Secretary of the Navy, Washington, D.C.

[21] Appl. No.: 860,839

[22] Filed: Mar. 31, 1992

[51] Int. Cl.[5] ..... B65H 54/00; B65H 55/00; B65H 55/04

[52] U.S. Cl. ..... 242/47; 242/1; 242/54 R; 242/128; 242/159; 242/167

[58] Field of Search ..... 242/159, 166, 167, 128, 242/47, 54 R, 1, 100.1, 107.1, 107.11, 107.13, 118.4, 118.41, 118.5

[56] References Cited

U.S. PATENT DOCUMENTS

| | | | |
|---|---|---|---|
| 1,186,131 | 6/1916 | Replogle | 242/100.1 |
| 2,490,837 | 12/1949 | Scott, Jr. | 242/167 X |
| 3,089,588 | 5/1963 | Correll | 242/167 X |
| 4,072,278 | 2/1978 | Petersen | 242/100.1 X |
| 5,022,603 | 6/1991 | Maree et al. | 242/159 X |
| 5,064,135 | 11/1991 | Williamson et al. | 242/118.4 |
| 5,114,091 | 5/1992 | Peterson et al. | 242/107.11 |
| 5,129,593 | 7/1992 | Smith | 242/159 |

*Primary Examiner*—Stanley N. Gilreath
*Attorney, Agent, or Firm*—James V. Tura; James B. Bechtel; Susan E. Verona

[57] ABSTRACT

A cable-pack winding and payout system is disclosed that will provide a torque-free cable payout from a wound cable pack, such as are found in ocean-deployed buoy packages. Dual feed spools are arranged so that the two halves of the cable can be simultaneously wound onto a single main spool. At time of payout, the pack is inertly payed out from the center or both ends and the payed-out cable has no curls or twists therein.

3 Claims, 5 Drawing Sheets

16
PRIOR ART
15
14
60
16

CABLE PACK WINDING AND PAYOUT SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to the cable and cable packs used in oceanographic devices or buoys and, more particularly, to a method and apparatus that enables the winding of extremely long lengths of such cable into cable packs that are used in these devices without placing a partial twist into the cable axis, which will then allow a torque-free cable payout.

Oceanographic devices or buoys, especially those oriented horizontally, can require extremely long lengths (sometimes exceeding 12,000 feet) of delicate communications cable. In many cases, there are at least two distinct parts of the device that must stay connected by the cable while they drift apart. The desigers of these devices attempt to build all of the necessary components, including the length of cable, into a very efficient and small package. A typical packaging method used for the cable is to wind the cable up on a mandrel and then withdraw the mandrel and leave the cable formed into a cable pack. A single feed spool and a single take-up spool are used and because no twist was formed as the cable was being wound, when the cable payed out from the pack, kinks or curls would appear in the cable as it unwound. U.S. Pat. No. 3,281,765 provides a dramatic illustration of the result.

Attempts at solving this problem centered on introducing a "backtwist" into the cable as it was wound. This involved rotating the supply spool so that the eventual payout twist would be cancelled by the backtwist. A sophisticated and costly machine, and careful monitoring, are necessary for this technique to be successful.

SUMMARY OF THE INVENTION

It is therefore an object of the present invention to provide a method and apparatus to quickly and efficiently form long strands into an efficient, tightly wound and sturdy cable pack of communications cable for oceanographic devices.

It is another object of the present invention to form a sturdy cable pack from a long length of cable without using intricate and costly machinery.

It is still another object of the present invention to form a sturdy cable pack from a long length of cable so that there will not be curls and twists in the cable upon cable pay-out.

These and other objects of the invention are disclosed in a method and apparatus for cable pack winding and pay-out where the length of cable is first wound onto a single feed spool, then the first half is taken off of the first feed spool and re-wound onto a second feed spool. Now the loop of cable, that represents the midpoint of the length, is placed on a mandrel and held thereon by a divider flange and that mandrel rotated until the cable, from both of the feed spools, is wound off of the feed spools and onto respective axially spaced sections of the mandrel on opposed sides of the divider flange.

The novel features which are believed to be characteristics of the invention, both as to its organization and methods of operation, together with further objects and advantages thereof, will be better understood from the following descriptions in connection with the accompanying drawings in which the presently preferred embodiments of the invention are illustrated by way of examples. It is to be expressly understood, however, that the drawings are for purposes of illustration and description only and are not intended as a definition of the limits of the invention.

BRIEF DESCRIPTION OF THE DRAWINGS

FIG. 4A shows an isolated isometric view of a closed cable pack wound using the instant invention;

FIG. 4B shows a view similar to FIG. 4A where the cable pack payout has started;

DETAILED DESCRIPTION OF THE PREFERRED EMBODIMENT

Figure 1:
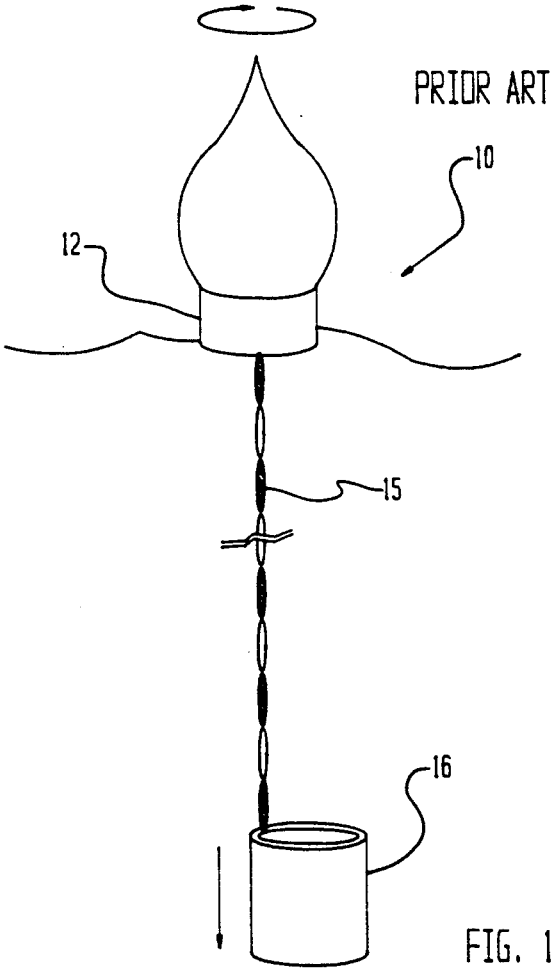
FIG. 1 shows a diagrammatic view of a prior art buoy and cable pack.
Figure 5:
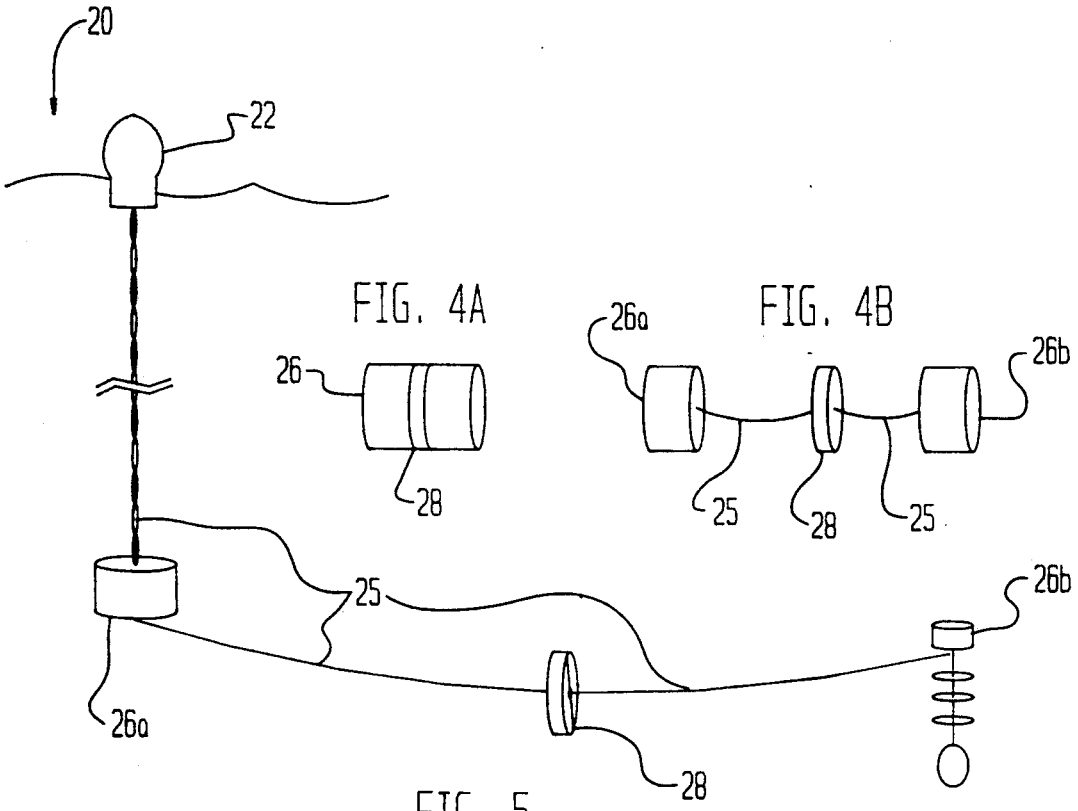
FIG. 5 shows a diagrammatic view of an oceanographic device as used in horizontal array.

The instant invention relates to a method and apparatus that allows un-twisted cable payout from oceanographic devices, such as 10 and 20 seen in FIGS. 1 and 5. It is common for such devices to have a surface flotation part, 12 and 22, respectively, and use a length of cable, 15 and 25, respectively, to connect the surface part to a cable pack 16 or 26.

In one known method of forming a cable pack, the length of cable (many times as long as 12,000 feet) is wound from a single feed or supply reel onto a take-up spool that consists of a collapsible mandrel or center post and removable outside-edge flanges. As the cable is carefully wound in layers onto the spool, adhesive is lightly applied to keep each section in place as the operation proceeds. Once all layers have been put in place, the flanges and collapsible mandrel are removed and the cable pack is freestanding an ready to be installed in the oceanographic device. Upon payout of the cable when the device (such as 10 in FIG. 1) is deployed, the inside end of the cable is pulled out of the pack parallel to the axis of the cable pack. This results in a helix or spiral (due to the cable's payout twist) of cable 15 (in FIG. 1) which, with straight vertical deployments will cause the surface part to rotate to untwist, and with horizontal arrangement (such as seen in FIG. 5) will cause the cable to curl or twist on itself (not shown) and possibly break. This event would lead to system failure and must be avoided.

Figures 2A, 2B:
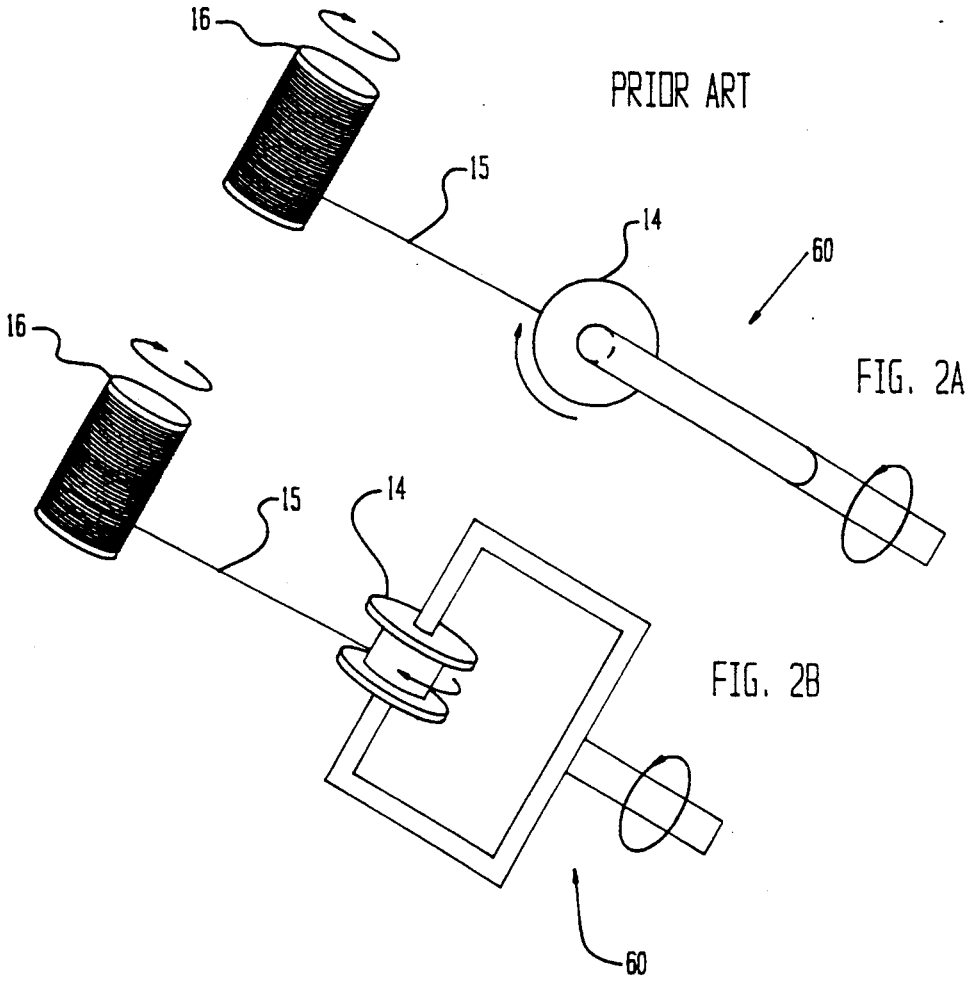
FIG. 2A shows a diagrammatic view of a first position of a prior art rotatable line feed device.
FIG. 2B shows a view similar to FIG. A2 with the prior art device rotated 90°.

FIGS. 2A and 2B show, in diagrammatic view, one known solution to the unintended consequences just described. Here, cable pack 16 is wound with a backtwist-per-turn. This method uses complicated machinery, such as at 60 to rotate supply reel 14 to feed cable 15 onto the take-up spool (not shown). The eventual payout will be inert with the payout twist and the backtwist cancelling each other out. Not only does this method require expensive machinery, but also careful monitoring.

Figure 3A:
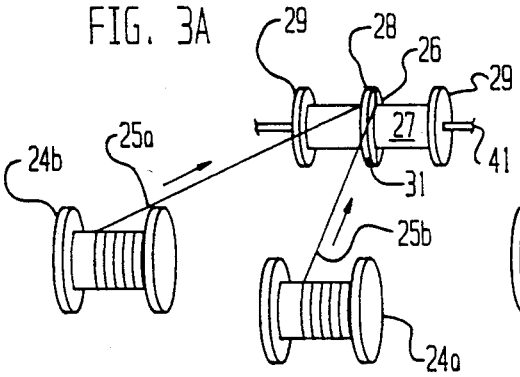
FIG. 3A shows a diagrammatic view of the starting position of the method and apparatus for cable pack winding.

FIG. 3A shows a diagrammatic view of the starting position and apparatus to wind curl-free cable. In this example, the total length of cable is first divided into substantially equal halves 25*a*, 25*b*, and the first half is unwound off of feed spool 24*a* and onto spool 24*b*. Now the loop 30 of cable section is placed at the longitudinal center of collapsible take-up mandrel 27 and a divider flange 28 and end flanges 29 removably secured thereon with the divider flange 28 place atop the loop of cable for clamping the loop of cable to the mandrel. Flange 28 can be made of multiple sections, as is shown, that are fastened to each other, as by a bolt 31, or other means, or it can be made out of a single piece with a slit cut therein. Flange 28, as will be explained, can be made from syntactic foam, or other similar materials, for a purpose to be described.

Figure 3B:
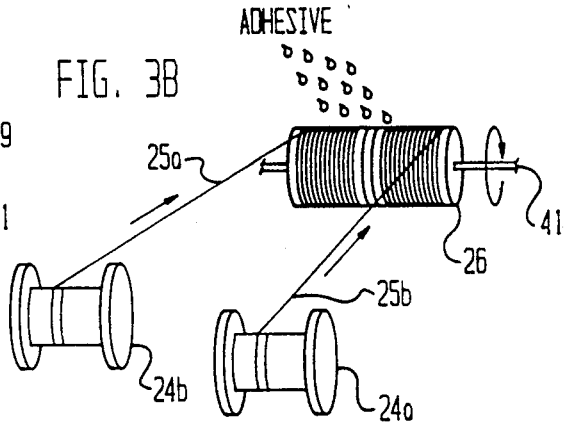
FIG. 3B shows a view similar to FIG. 3A but with the cable pack fuller wound using the instant invention.

Once loop 30 is secured, take-up mandrel 27 is rotated, as by axle 41, and two separate sections of cable are built up until, as shown in FIG. 3B, all cable is used from feed spools 24*a*, 24*b*. A light adhesive can be sprayed over the layers, as is known, to keep individual loops together, to maintain cable pack stability and to provide for orderly deployment. FIGS. 4A, 4B and 5 show cable pack 26 and the payout of cable 25 from section 26*a* and 26*b* after the collapsible mandrel 27 and end flanges 29 are separated from the cable pack. Payout from these two Sections 26*a* and 26*b* effectively cancels any cable twist.

Figure 6A:
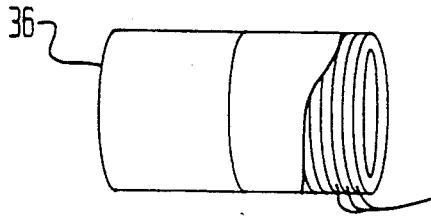
FIG. 6A shows an isolated view of an alternate embodiment of a cable pack wound by the instant invention.
Figure 6B:
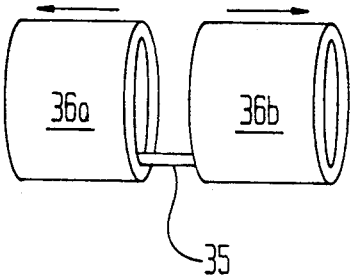
FIG. 6B shows a view similar to FIG. 6A but where the cable pack payout has just begun.
Figure 6C:
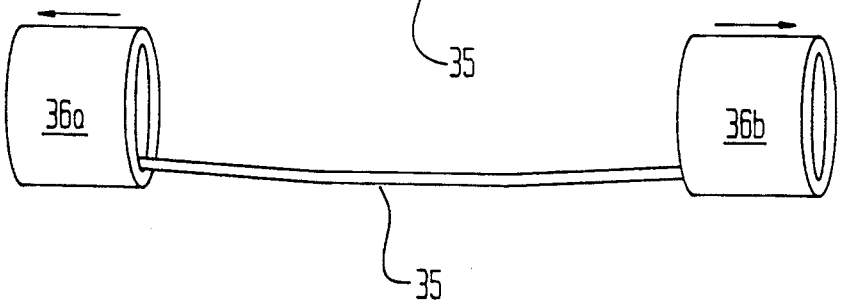
FIG. 6C shows a view similar to FIG. 6A but where the cable pack has more fully separated in its deployment.

The instant invention has proved particularly useful in the payout of long horizontal cables where there is no opportunity to allow a surface float or free end of the suspension to rotate and alleviate the torque built up from a nontwisted cable pack payout. Additionally, with long cable lenghts, it is desirable to have buoyancy modules, such as center flange 28, at pre-selected intervals on the cable. Through calculations, the weight of a length of cable can be determined, and a buoyant disc of proper size designed to carry that weight. Certainly, though, flange 28 can be removed and just the two-part cable pack 36 (composed of halves 36*a* and 36*b*) deployed, as shown in FIGS. 6A, 6B and 6C.

Finally, while the multi-part cable pack and method of winding have been described with reference to a particular embodiment, it should be understood that the embodiment is merely illustrative as there are numerous variation and modifications which may be made by those skilled in the art. Thus, the invention is to be construed as being limited only by the spirit and scope of the appended claims.

What we claim is:

1. A method for forming a cable pack to insure a twist-free payed-out cable comprising the steps of:

a) winding all of the desired length of cable onto a first feed spool;

b) rewinding substantially one half of said length onto a second feed spool thereby creating, at the approximate midpoint thereof, a loop of cable;

c) placing said loop at the longitudinal center of a collapsible take-up mandrel;

d) placing a divider flange around said mandrel atop said loop to divide the mandrel into axially spaced sections and clamp the loop to the mandrel;

e) rotating said mandrel to re-wind cable off of said feed spools onto respective said axially spaced sections of said mandrel to form a two part cable pack; and

2. The method of claim 1, including the additional step of removing said divider flange.

3. The method of claim 2, including the additional step of applying a coating of adhesive to the wound cable on the mandrel.

* * * * *